US007633025B2

(12) United States Patent
Smith et al.

(10) Patent No.: US 7,633,025 B2
(45) Date of Patent: Dec. 15, 2009

(54) INERTIAL SWITCH USING FULLY RELEASED AND ENCLOSED CONDUCTIVE CONTACT BRIDGE

(75) Inventors: Joshua R. Smith, Seattle, WA (US); John Heck, Berkeley, CA (US); Kishore Sundara-Rajan, Seattle, WA (US)

(73) Assignee: Intel Corporation, Santa Clara, CA (US)

( * ) Notice: Subject to any disclaimer, the term of this patent is extended or adjusted under 35 U.S.C. 154(b) by 175 days.

(21) Appl. No.: 11/729,579

(22) Filed: Mar. 29, 2007

(65) Prior Publication Data

US 2008/0237003 A1 Oct. 2, 2008

(51) Int. Cl.
*H01H 35/02* (2006.01)

(52) U.S. Cl. ..... 200/61.45 R; 200/61.5

(58) Field of Classification Search ..... 200/61.45 R, 200/61.08, 61.45–61.53
See application file for complete search history.

(56) References Cited

U.S. PATENT DOCUMENTS

| | | | | |
|---|---|---|---|---|
| 3,831,163 | A * | 8/1974 | Byers | 340/539.31 |
| 4,638,130 | A * | 1/1987 | Grossler et al. | 200/61.45 R |
| 4,639,668 | A * | 1/1987 | Petit et al. | 324/207.26 |
| 6,768,066 | B2 * | 7/2004 | Wehrenberg | 200/61.49 |
| 7,022,213 | B1 * | 4/2006 | Austen et al. | 204/432 |
| 7,307,228 | B2 * | 12/2007 | Wehrenberg | 200/61.49 |
| 7,384,821 | B2 * | 6/2008 | Sung | 438/122 |

* cited by examiner

*Primary Examiner*—Michael A Friedhofer
*Assistant Examiner*—Lisa N Klaus
(74) *Attorney, Agent, or Firm*—Kevin A. Reif

(57) ABSTRACT

A micro-electromechanical system (MEMS) switch comprises a trench formed in a substrate. A free moving conductive mass may be formed within the cavity. When the switch is moved or otherwise acted upon my an inertial force to conductive mass makes contact with a pair of electrodes partially covering the trench thus turning the switch on.

6 Claims, 2 Drawing Sheets

INERTIAL SWITCH USING FULLY RELEASED AND ENCLOSED CONDUCTIVE CONTACT BRIDGE

FIELD OF THE INVENTION

Embodiments of the present invention relate to inertial sensors and, more particularly to micro-electromechanical system (MEMS) switches.

BACKGROUND INFORMATION

Inertial sensors, such as accelerometers, have wide applications in many industries. Most notable perhaps being in the aerospace, military, and automotive industries. More recently, they may be found in computer video game controllers where the controller senses user body movements.

One type of traditional accelerometer is the mercury switch. Typically this comprises a sealed tube containing a pair of electrodes and a small amount of mercury. When the tube is tilted or the mercury otherwise accelerated it makes contact with the electrodes and completes an electrical circuit. This may be considered a type of one-bit accelerometer; one bit, because it's either on or off. Unfortunately, mercury is toxic and containment may be an issue. Further, such switches are relatively large, and cannot be fabricated by photolithography.

Another type of accelerometer or switch is the spring-post sensor which is based on low spring constant designs. They typically comprise a partially released cantilever moving normal to the surface of an electrode pair, thus varying the transimpedance between the electrodes. Though it can be made robust, this design has inherent problems. The strain at the edge of the anchors of the beam or cantilever is an order of magnitude greater than the average strain in the structure. This repetitive transient strain gradient changes the mechanical properties of the switch, thus altering its switching thresholds as a function of time. Eventually, the edge of the anchor may become weak, and break under mechanical stress.

DETAILED DESCRIPTION

According to embodiments of the invention, a micro-electromechanical system (MEMS) inertial switch operates using a fully released and enclosed conductive bridging element. A non-anchored conductive mass may be placed inside a cavity within a substrate. Two metal layers are patterned on the substrate so that they are mechanically connected to the substrate, but electrically isolated from the substrate. When inertial forces act in a direction towards the contacts, the conductive mass comes in contact with the electrodes, thus turning the switch "ON". Conversely, when the forces are directed away from the electrodes, the conductive mass is displaced from its contact position, thus turning the switch "OFF". Rather than measuring just changes in resistance resulting from changes in mass configuration, changes in capacitance may be measured as well.

Figure 1:
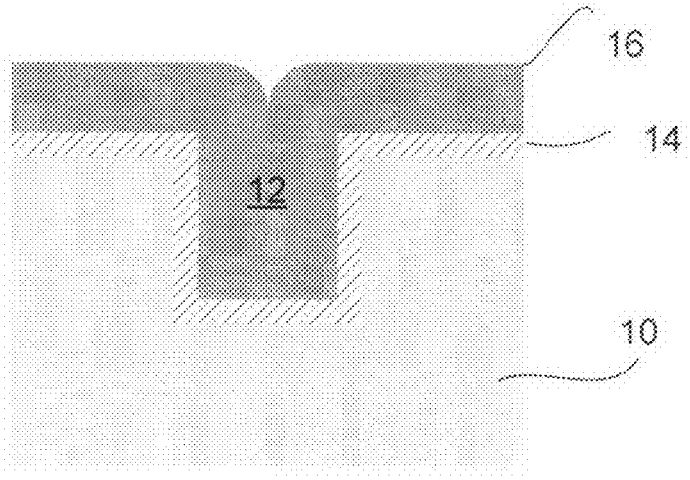
FIG. 1 is a view of a substrate having a trench and a conductive layer deposited thereon for forming an inertial switch.

Referring now to FIG. 1, there is shown a substrate 10, such as, for example silicon. A trench 12 may be formed in the substrate 10. For example, the trench 12 may be etched into silicon substrate 10 using a deep reactive ion etching (DRIE) process or other suitable method. A sacrificial layer 14 may then be deposited into the cavity 12. The sacrificial layer 14 may be, for example $SiO_2$, and may conform to the sides of the cavity 12. Thereafter, a thick metal layer 16 may be deposited, for example, by electroplating. The metal layer 16 having sufficient thickness such that it fills the entire trench 12.

Figure 2:
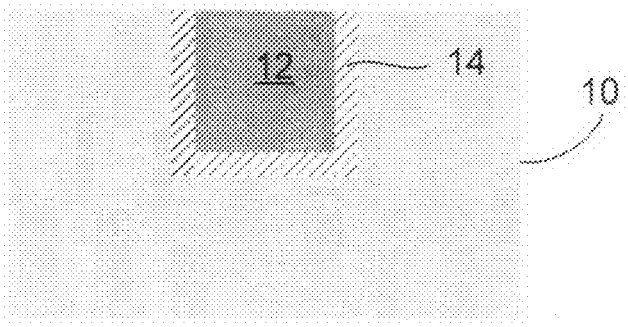
FIG. 2 is a view of an of the substrate after polishing to make the conductive layer flush with the surface of the silicon substrate.

As shown in FIG. 2, the metal layer 16 and the sacrificial layer 14 may then be partially removed to expose the top of the silicon substrate 10. The partial removal may be accomplished for example by chemical mechanical polishing such that what remains is planar or flush with the surface of the silicon substrate 10.

Figure 3:
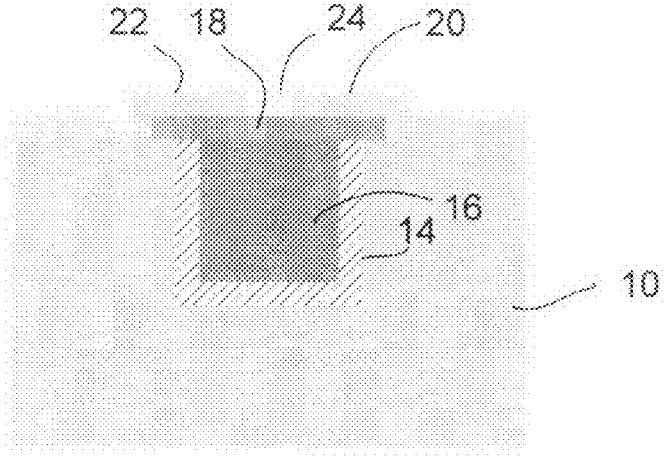
FIG. 3 is a view of the substrate after the addition of the electrical contacts.
Figure 4:
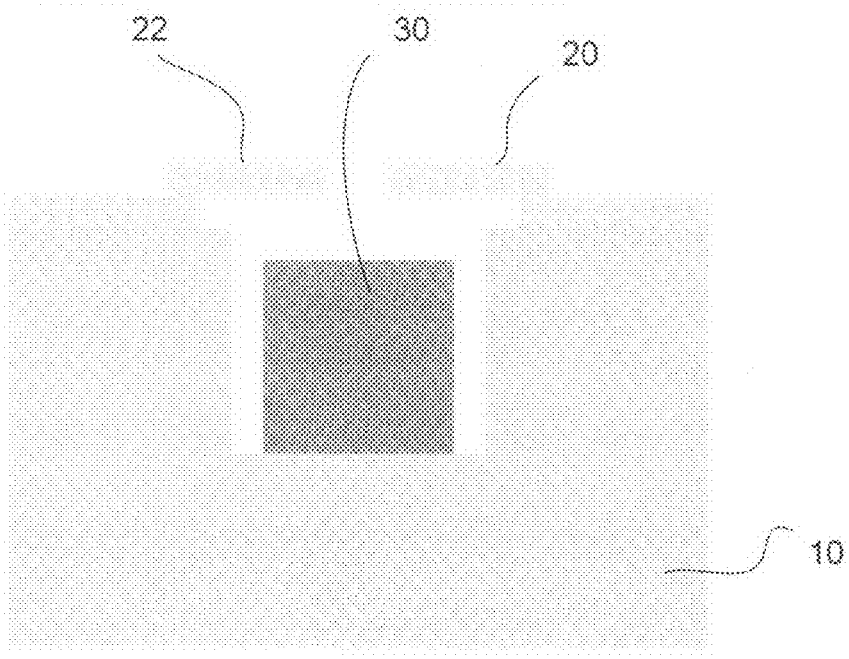
FIG. 4 is a view of the inertial switch after the release of the conductive mass.

Referring to FIG. 3, a second sacrificial layer 18 may be deposited to cover the top of the trench 12. Thereafter a pair of electrodes or contacts, 20 and 22, may be patterned to form the gap 24. The sacrificial materials 14 and 18 may then be removed, such as by etching, thus releasing the conductive mass 30 formed from the remainder of the conductive layer 16, as shown in FIG. 4.

Figure 5:
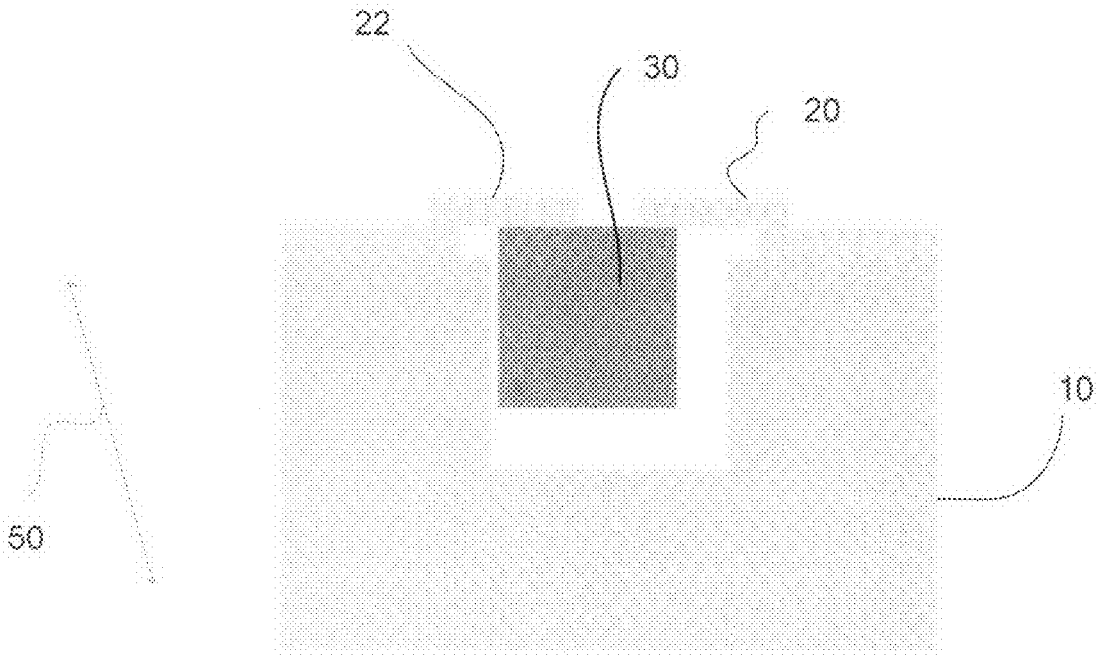
FIG. 5 is a view of the inertial switch accelerated in a direction causing the conductive mass to move and make contact with the electrical contacts thus sensing an inertial force or movement.

Referring to FIG. 5, the conductive mass 30 is free to move within the trench 12 and does so when acted upon by an inertial force such as gravity or acceleration or deceleration illustrated by arrow 50. When a force displaces the conductive mass 30 to bridge the space between contacts 20 and 22, an electrical signal may flow between the contacts via the conductive mass 30 thus turning the switch on or off and allowing detection of the inertial force. Rather than measuring just changes in resistance 51 resulting from changes in mass configuration, changes in capacitance 52 may be measured as well.

One-bit accelerometers such as this have many uses such as detecting activity of hand-held battery-powered devices, and putting device into sleep mode when it is not being used to conserve power. This device may also find application in, for example, parking the hard drive in laptops in case of mechanical shock. These low-power accelerometers can also be used in RFID-powered sensors, which are extremely power constrained.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A micro-electromechanical system (MEMS) switch, comprising:

a trench formed in a substrate;

a conductive mass free to move in any direction within the trench; and a pair of contacts partially covering an open end of the trench, wherein when the conductive mass bridges the pair of contacts the switch turns on and when the conductive mass moves away from the pair of contacts the switch turns off.

2. The MEMS switch as recited in claim 1, wherein the switch comprises a one-bit accelerometer.

3. The MEMS switch as recited in claim 1 wherein resistance is measured between the pair of contacts.

4. The MEMS switch as recited in claim 1 wherein capacitance is measured between the pair of contacts.

5. The MEMS device as recited in claim 1 further comprising:

a gap between the pair of contacts, the gap being smaller than the conductive mass.

6. The MEMS switch as recited in claim 1 wherein the switch detects an inertial force.

* * * * *